US007850145B2

(12) United States Patent
Heravi et al.

(10) Patent No.: US 7,850,145 B2
(45) Date of Patent: Dec. 14, 2010

(54) PORTABLE PULLING TOOL

(75) Inventors: Oliver Heravi, Tigard, OR (US); Brent Nasset, Salem, OR (US); Ty Hargroder, Portland, OR (US)

(73) Assignee: Warn Industries, Inc., Milwaukie, OR (US)

( * ) Notice: Subject to any disclaimer, the term of this patent is extended or adjusted under 35 U.S.C. 154(b) by 481 days.

(21) Appl. No.: 11/697,093

(22) Filed: Apr. 5, 2007

(65) Prior Publication Data

US 2008/0246011 A1 Oct. 9, 2008

(51) Int. Cl.
*B66D 1/50* (2006.01)

(52) U.S. Cl. ..... 254/275; 254/274; 254/219; 254/241

(58) Field of Classification Search ..... 254/323, 254/274, 275, 342, 344, 219, 228, 241
See application file for complete search history.

(56) References Cited

U.S. PATENT DOCUMENTS

| | | | | | |
|---|---|---|---|---|---|
| 3,265,362 | A | | 8/1966 | Moody | |
| 3,278,160 | A | | 10/1966 | Ake | |
| 3,645,503 | A | * | 2/1972 | Doerfling | 242/157.1 |
| 3,648,977 | A | | 3/1972 | Rohrer et al. | |
| 4,004,780 | A | | 1/1977 | Kuzarov | |
| 4,033,552 | A | * | 7/1977 | Kuzarov | 254/342 |
| 4,123,040 | A | * | 10/1978 | Kuzarov | 254/342 |
| 4,426,064 | A | * | 1/1984 | Healy | 254/342 |
| 4,461,460 | A | * | 7/1984 | Telford | 254/344 |
| 4,518,153 | A | * | 5/1985 | West et al. | 254/274 |
| 4,545,567 | A | * | 10/1985 | Telford et al. | 254/344 |
| 4,565,352 | A | * | 1/1986 | Hasselmann et al. | 254/344 |
| 4,736,929 | A | * | 4/1988 | McMorris | 254/344 |
| 4,873,474 | A | | 10/1989 | Johnson | |
| 4,928,925 | A | * | 5/1990 | Christison | 254/272 |
| 5,214,359 | A | | 5/1993 | Herndon et al. | |
| 5,284,325 | A | * | 2/1994 | Sasaki et al. | 254/274 |
| 5,368,279 | A | * | 11/1994 | Ottemann et al. | 254/342 |
| 5,522,582 | A | * | 6/1996 | Dilks | 254/323 |
| 5,648,887 | A | | 7/1997 | Herndon et al. | |
| 6,046,893 | A | | 4/2000 | Heravi | |
| 6,497,400 | B2 | * | 12/2002 | Buhlmayer et al. | 254/342 |
| 6,604,731 | B2 | | 8/2003 | Hodge | |
| 6,631,886 | B1 | * | 10/2003 | Caudle et al. | 254/327 |
| 6,966,544 | B2 | * | 11/2005 | McCormick et al. | 254/342 |
| 7,377,486 | B2 | * | 5/2008 | Winter et al. | 254/380 |
| 2004/0263100 | A1 | * | 12/2004 | Heravi et al. | 318/280 |
| 2007/0175951 | A1 | * | 8/2007 | Shelton et al. | 227/176.1 |
| 2010/0121493 | A1 | * | 5/2010 | Christensen et al. | 700/275 |

FOREIGN PATENT DOCUMENTS

| | | |
|---|---|---|
| EP | 0515185 A1 | 11/1992 |
| GB | 2013375 | 8/1979 |
| JP | 06-083458 | 3/1994 |
| JP | 2003-252573 | 9/2003 |

* cited by examiner

*Primary Examiner*—Emmanuel M Marcelo
(74) *Attorney, Agent, or Firm*—Harness, Dickey & Pierce, P.L.C.

(57) ABSTRACT

A portable pulling tool is provided including an integrally formed one-piece gear case for positioning all of the gear train components. The gear train includes a combination of helical gears and a differential planetary gear unit in a unique configuration. A motor control system is provided to automatically shut off the motor when a predetermined current load is detected. A multi-segment LED is provided to indicate to the user the amount of load that is being applied.

27 Claims, 16 Drawing Sheets

MOTOR CURRENT AT FULL SPEED (NO LOAD)

MOTOR CURRENT AT VARIABLE SPEED (NO LOAD)

MOTOR INRUSH CURRENT AT STARTUP

PORTABLE PULLING TOOL

FIELD

The present disclosure relates to a pulling device, and more particularly, to a portable pulling tool that is provided with a durable construction and reliable gear train and motor control system therefore.

BACKGROUND AND SUMMARY

The statements in this section merely provide background information related to the present disclosure and may not constitute prior art.

Winches and hoists are used for a wide range of applications and many different sizes and types of winches and hoists are produced. Winches are commonly mounted to bumpers of off-road vehicles and can be utilized to pull a vehicle from a stuck condition, or to pull the vehicle up a steep incline, by attaching one end of the cable of the winch to a tree or other stationary object. The industrial winches and hoists are also utilized for lifting applications or on a job site, shop, barn, or home. Industrial winches and hoists are typically required to be bolted down or otherwise affixed to a stationary object for use and can sometimes be heavy in weight and cumbersome to carry.

Although the maximum working capacity of winches and hoists are portrayed in the user manuals and warning labels, it is likely that a winch can still be misused by overloading. This is an occurrence that excessive load is applied to a winch or hoist, which could exceed its maximum operating capacity. During this undesirable condition, the winch or hoist motor operates near stall or at stall torque that could cause a breakdown.

The pulling tool of the present disclosure provides a portable, easy to carry, relatively lightweight construction for a pulling tool. The pulling tool of the present disclosure includes a durable construction while maintaining portability and reliability. The portable pulling tool of the present disclosure includes a one-piece casting to locate and support all of the gear components in precise alignment. The system gear train utilizes a combination of helical gearing to accommodate the motor high speed and a differential planetary gear system which has a compact size and self-braking capability.

The system also includes an electronic load limiter that monitors motor current and drives a multi segment LED that indicates approximately how much load is being pulled. The controller algorithm processes various motor current waveforms and determines motor effective current that is proportional to the given physical load on the system When the maximum load is achieved, the controller shuts the motor off for a short period of time while blinking a set of LEDs indicating that the unit is at an overload condition.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

Figure 1:
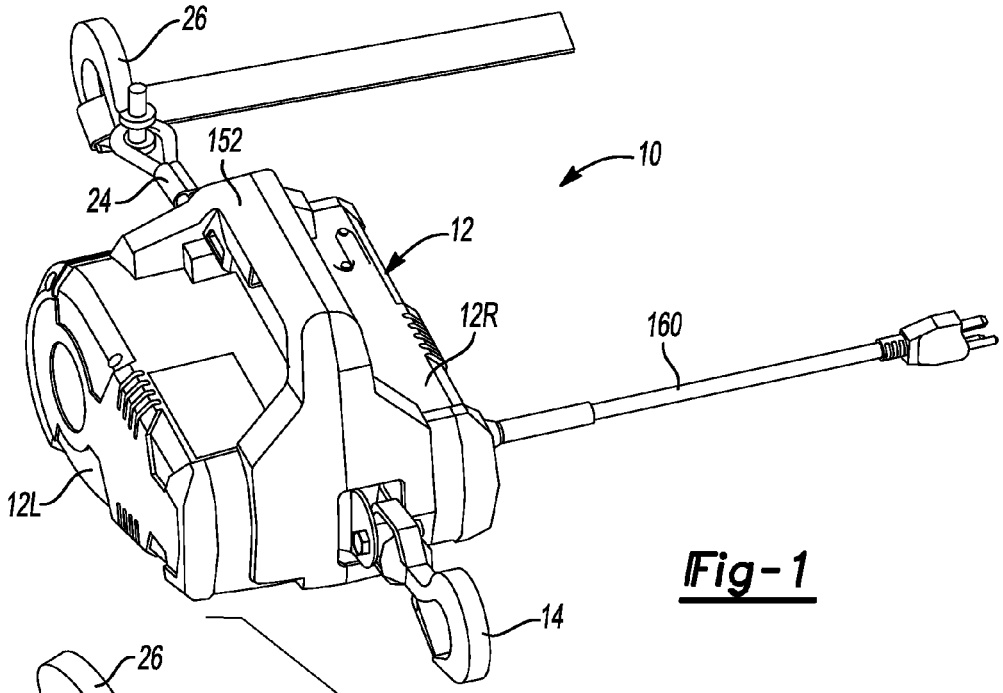
FIG. 1 is a perspective view of the portable pulling tool according to the principles of the present disclosure.

The following description is merely exemplary in nature and is not intended to limit the present disclosure, application, or uses. It should be understood that throughout the drawings, corresponding reference numerals indicate like or corresponding parts and features.

Figure 2:
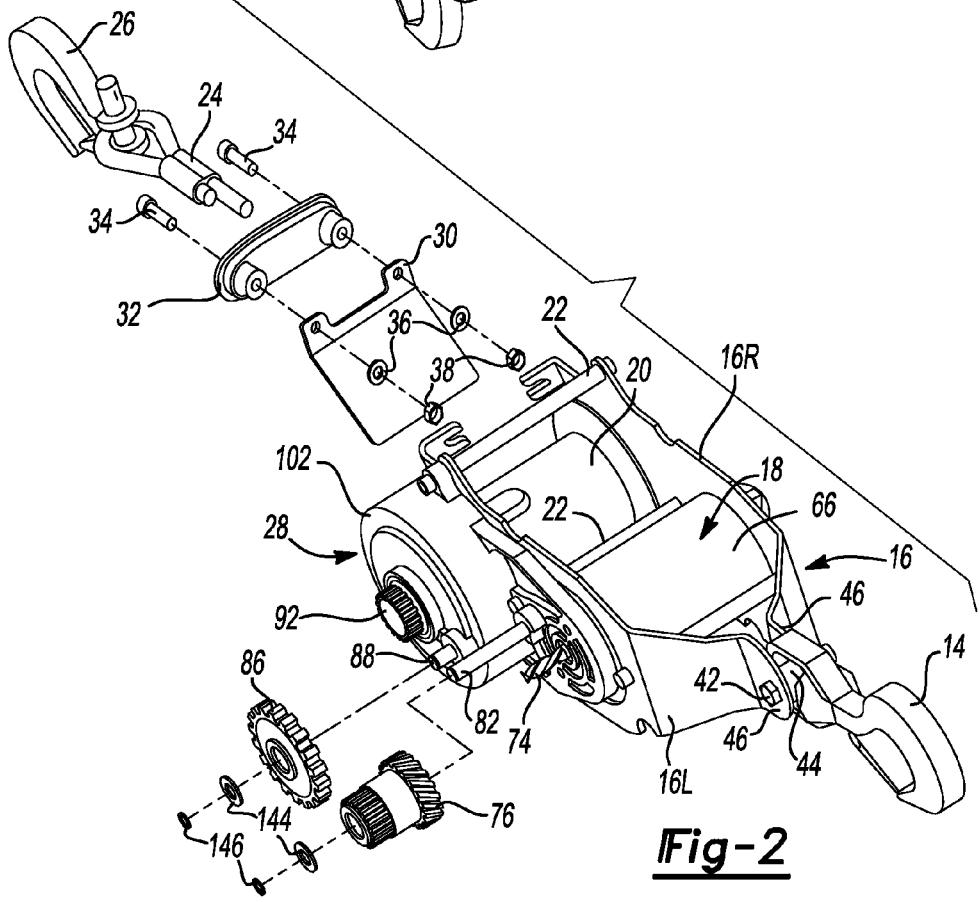
FIG. 2 is a partial exploded view of the portable pulling tool with the housing removed for illustration purposes.
Figure 3:
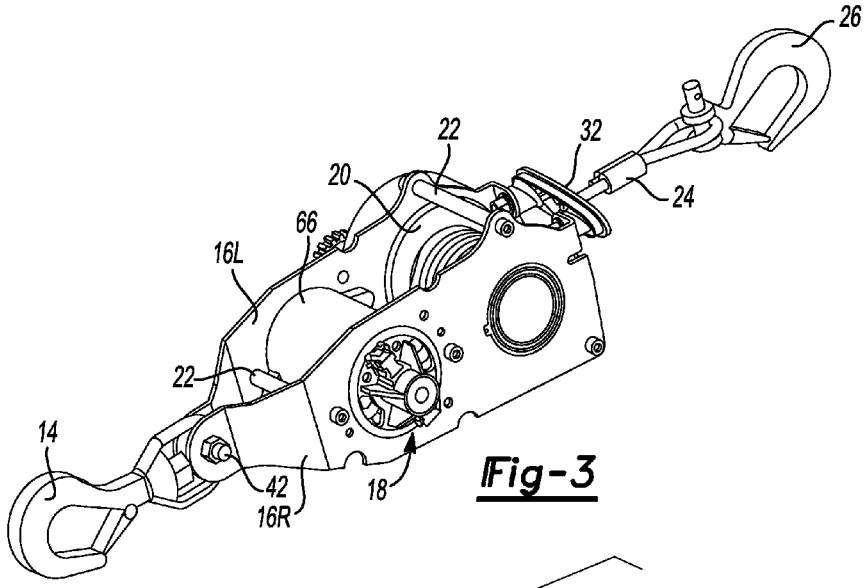
FIG. 3 is a perspective view of the portable pulling tool with the housing removed for illustration purposes.

With reference to FIGS. 1-20, the portable pulling tool 10 according to the principles of the present disclosure will now be described. As shown in FIG. 1, the portable pulling tool 10 includes a housing 12 including a left housing portion 12L and a right housing portion 12R. The left and right housing portions 12L, 12R are secured together by screws 17, best seen in FIG. 5. The swivel hook assembly 14 is pivotally attached to a bracket assembly 16 (best shown in FIG. 2) which is disposed within the housing 12. As shown in FIG. 2, the bracket assembly 16 includes a left bracket 16L and a right bracket 16R. A motor assembly 18 is disposed between the left and right brackets 16L, 16R and is drivingly engaged with a drum 20 which is rotatably supported between the left and right brackets 16L, 16R. A plurality of tie rods 22 are provided for interconnecting the left and right brackets 16L, 16R in an appropriate spaced relationship. The drum 20 is provided with a wire rope assembly 24 which is adapted to be wound onto and unwound from the drum 20. A hook assembly 26 is running to the end of wire rope assembly 24. The wire rope assembly 24 extends out from the housing 12 at an end opposite from the swivel hook assembly 14 and through operation of the motor assembly 18, which provides drive torque through a drive train 28 to the drum 20, the wire rope assembly 24 can be wound onto and unwound off from the drum 20.

Figure 9:
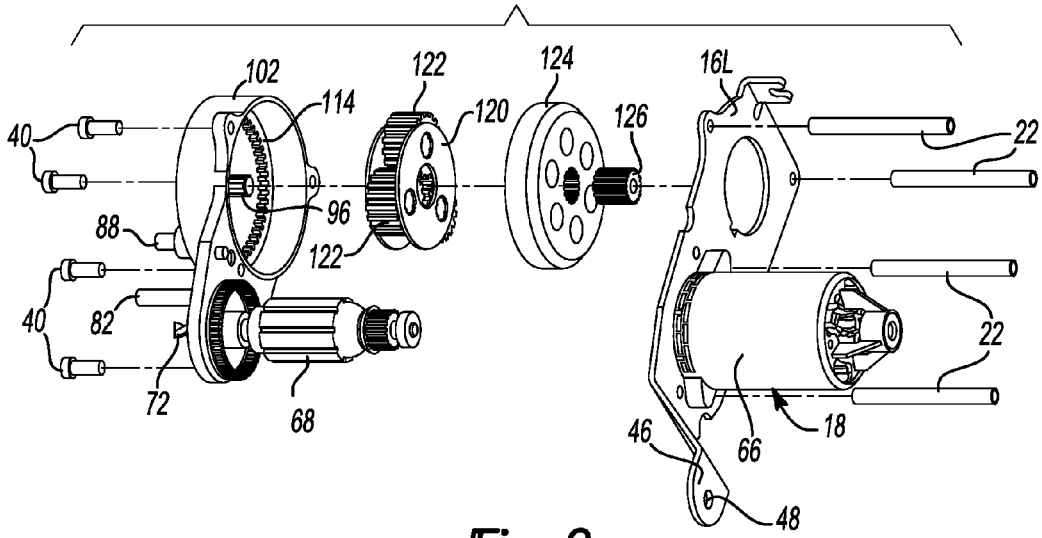
FIG. 9 is a partial exploded view of the integrated gear housing and drive train components.
Figure 10:
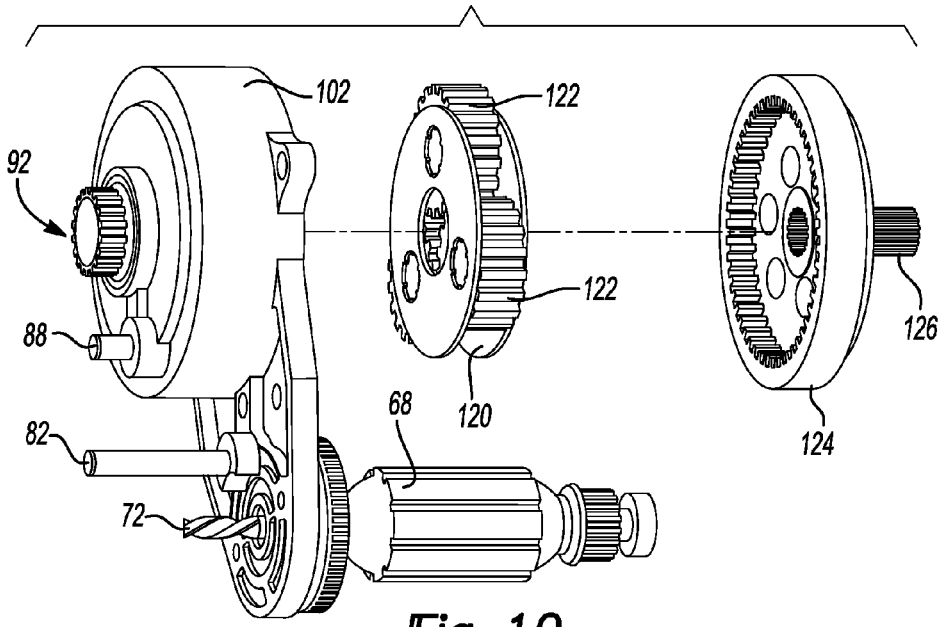
FIG. 10 is a partial exploded view of the integrated gear housing and drive train components.
Figure 11:
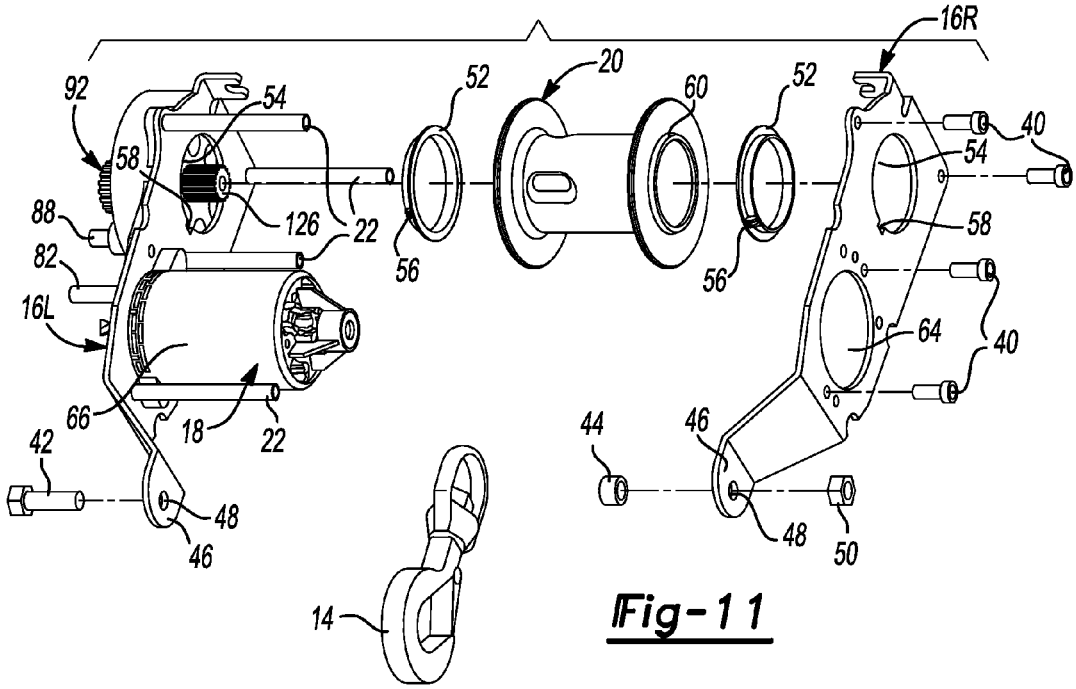
FIG. 11 is a partial exploded view of the bracket assembly and drum according to the principles of the present disclosure.

A tensioner plate 30 and Hawse fairlead 32 are mounted to the left and right brackets 16L, 16R to guide the wire rope assembly 24 through the housing 12. The tensioner plate 30 and Hawse fairlead 32 are fastened to the left and right brackets 16L, 16R by fasteners 34, washers 36, and lock nuts 38. The tie rods 22 are supported to each of the left and right brackets 16L, 16R by fastener 40, as best illustrated in FIGS. 9 and 11. The swivel hook assembly 14 is connected to the left and right brackets 16L, 16R by a fastener 42. A spacer 44 is provided between forward ends 46 of the left and right brackets 16L, 16R and the fastener 42 extends through apertures 48 provided in the forward ends 46 of the left and right brackets 16L, 16R, as well as through the spacer 44, as best illustrated in FIG. 11. A nut 50 is engaged with the fastener 42 for securing the swivel hook assembly 14 between the brackets 16L, 16R.

A pair of drum bushings 52 are received in corresponding mounting apertures 54 provided in the left and right brackets 16L, 16R, as best shown in FIG. 11. The drum bushings 52 each include a projecting portion 56 which are received in corresponding recesses 58 provided in the aperture 54 for preventing rotation of the drum bushings 52. The drum 20 is provided with axially extending flanged portions 60 as illustrated in FIG. 11, that are received within the drum bushings 52 for rotatably supporting the drum 20 between the left and right brackets 16L, 16R.

Figure 12A:
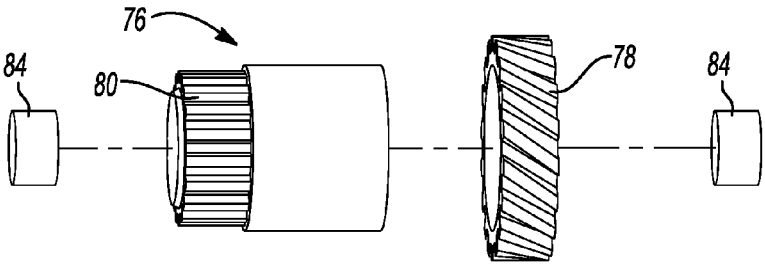
FIG. 12*a* is an exploded view of the primary gear subassembly according to the principles of the present disclosure.
Figure 12B:
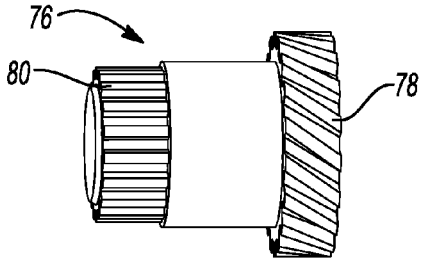
FIG. 12*b* is an assembled view of the primary gear subassembly according to the principles of the present disclosure.
Figure 13A:
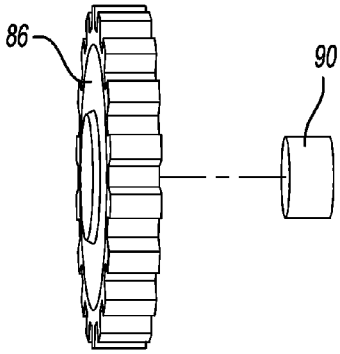
FIG. 13*a* is an exploded view of the idler gear subassembly according to the principles of the present disclosure.
Figure 13B:
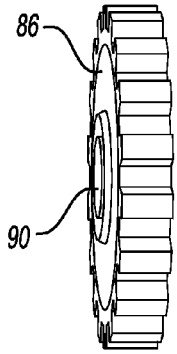
FIG. 13*b* is an assembled view of the idler gear subassembly according to the principles of the present disclosure.
Figure 14A:
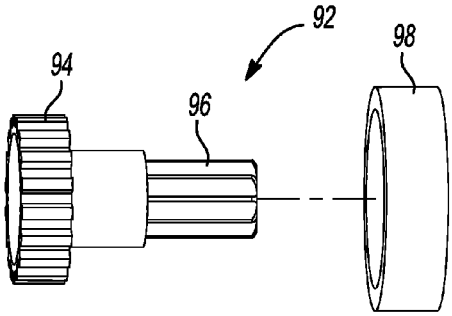
FIG. 14*a* is a exploded perspective view of the sun gear subassembly according to the principles of the present disclosure.
Figure 14B:
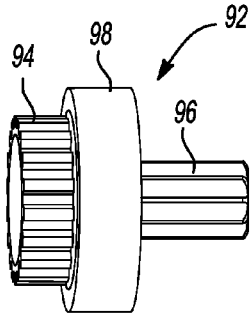
FIG. 14*b* is an assembled view of the sun gear subassembly according to the principles of the present disclosure.
Figure 15:
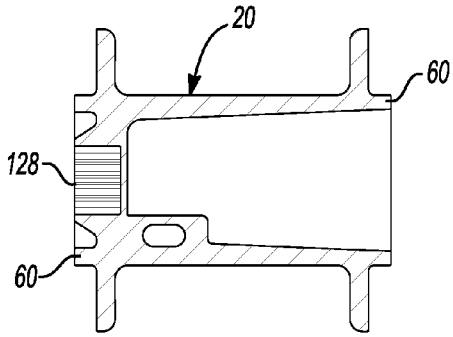
FIG. 15 is a cross-sectional view of the drum according to the principles of the present disclosure.

The left and right brackets 16L, 16R each include an aperture 64 for receiving the motor assembly 18 therein. The motor assembly 18 includes a housing 66 that supports a motor stator therein as is known in the art. The motor assembly also includes an armature 68 (best illustrated in FIG. 6, 7 and 10). The armature 68 is connected to an output shaft 70 that is connected to a helical gear 72 of the drive train 28. The helical gear 72 is meshingly engaged with a primary gear assembly 76 which, as best shown in FIGS. 12(*a*), 12(*b*), includes a helical gear portion 78 fixably mounted to an intermediate gear portion 80 which is rotatably supported on a gear shaft 82 by a pair of bearings 84. The intermediate gear portion 80 is in intermeshing engagement with a second intermediate/idler gear assembly 86 which is rotatably supported on an idler shaft 88 by a bearing 90, as best shown in FIGS. 13*a*, 13*b*. A sun gear assembly 92, as best shown in FIGS. 14*a*, 14*b*, includes a third intermediate gear portion 94 that meshingly engages the second intermediate/idler gear 86 and is fixably attached to a sun gear portion 96. The sun gear assembly 92 is rotatably supported by a bearing 98 within an aperture 100 provided in a one-piece integrally formed/cast gear housing 102.

The gear housing 102 includes an aperture 104 that receives a bearing 105 for rotatably supporting the motor output shaft 70. Gear housing 102 also includes an aperture for receiving gear shaft 82 as well as a further aperture 108 for receiving idler shaft 88. Gear housing 102 also includes a recessed cavity 110, best shown in FIGS. 7 and 8, in which a differential planetary gear unit 112 is disposed. The differential planetary gear unit includes a ring gear 114 non-rotatably affixed within the recessed chamber 110. In particular, the ring gear 114 includes a plurality of recessed notches 116 (FIG. 6) which engage with a plurality of corresponding projections 118 (FIG. 8) disposed within the recessed chamber 110. A planetary gear set and carrier assembly 120 (FIG. 9) is supported within the recessed chamber 110 such that the planetary gears 122 are meshingly engaged with the fixed ring gear 114 and sun gear 96. A rotatable ring gear 124 is also disposed within the recessed chamber 110 of gear housing 102 and is in meshing engagement with the planetary gears 122.

The fixed ring gear 114 of the differential planetary gear system is provided with fewer teeth than the rotatable ring gear 124, so as to provide a substantial gear reduction between the motor drive shaft 70 and the drive connection to the drum 20. Without intending to be limited by example, the fixed ring gear 114 may include 48 teeth while the rotatable ring gear 124 may include 51 teeth, although it should be understood that other numbers of teeth may be utilized. The rotatable ring gear 124 is provided with a splined drive sleeve 126 which engages internal spines 128 provided on the drum 20.

With the gear train 28 of the present disclosure, the combination of the differential planetary gearing and helical gearing is provided in a unique combination. The helical gearing accommodates the high motor speed and the differential planetary gearing provides an appropriate gear reduction with a compact construction and self-braking capability.

Figure 6:
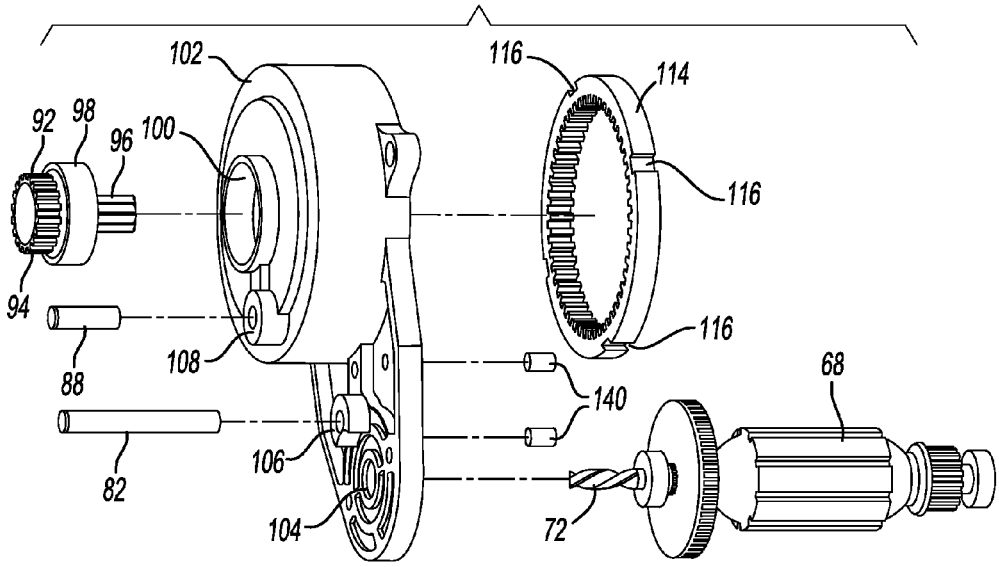
FIG. 6 is a perspective view of the integrated gear housing with several components of the gear train shown for illustrated purposes.
Figure 7:
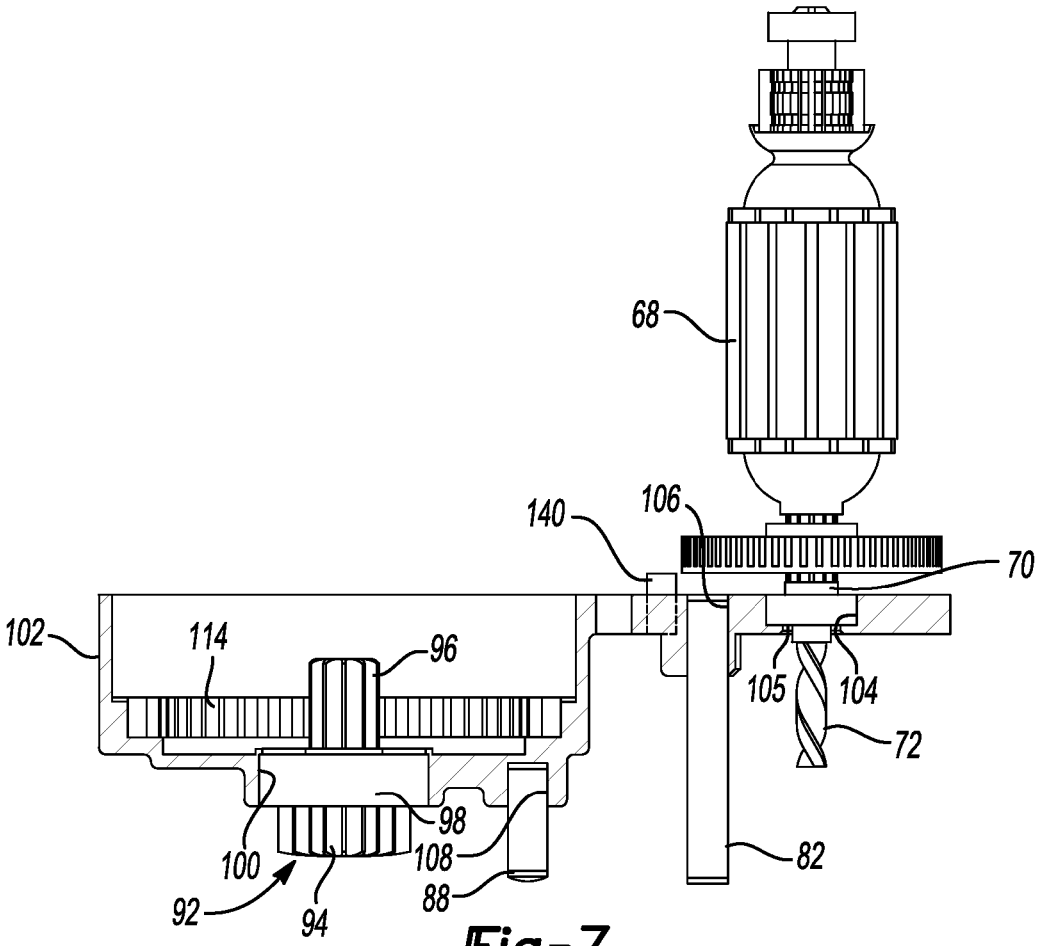
FIG. 7 is cross-sectional view of the integrated gear housing according to the principles of the present disclosure.
Figure 8:
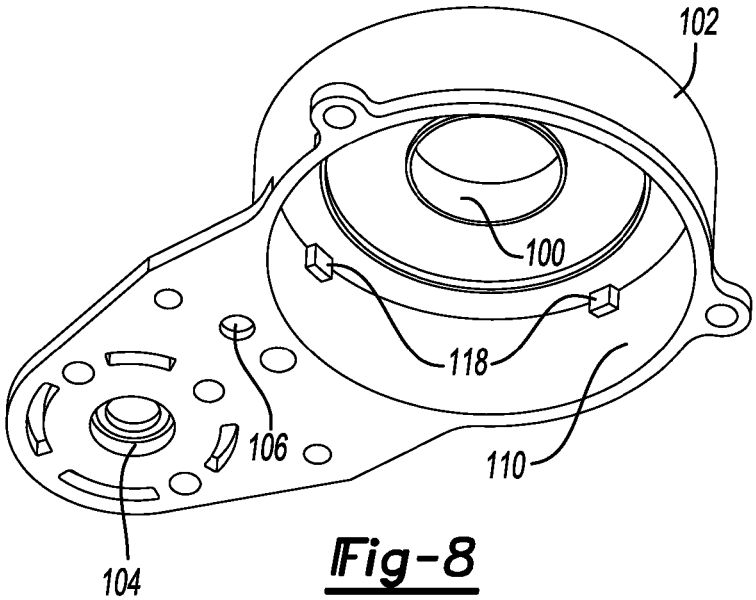
FIG. 8 is a rear perspective view of the integrated gear housing shown in FIGS. 6 and 7.

The integrated gear housing 102 being formed as a single casting controls the location of all of the gear components. The gear efficiency is dependent upon precise alignment of all of the gear components which can be precisely located with the integrated gear housing 102. As illustrated in FIG. 6, the gear housing 102 can be further provided with dowel pins 140 for locating the gear housing 102 relative to the left bracket 16L. Furthermore, the fasteners 40 that engage tie rods 22 are utilized to securely mount the gear housing 102 to the left bracket 16L, as best illustrated in FIG. 9. The primary gear assembly 76 is mounted to the gear shaft 82 and the idler gear subassembly 86 is mounted to the idler shaft 88 utilizing a washer 144 and retainer clip 146.

Figure 4:
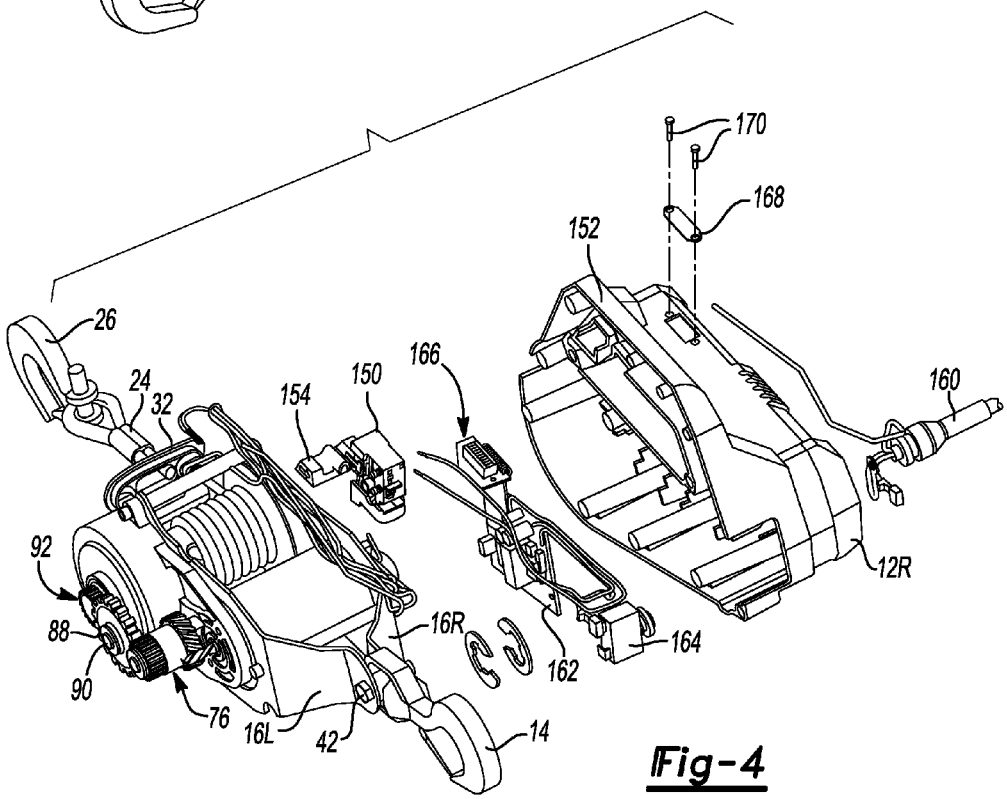
FIG. 4 is a perspective partially exploded view of the portable pulling tool with the right hand housing shown removed for illustration purposes.
Figure 5:
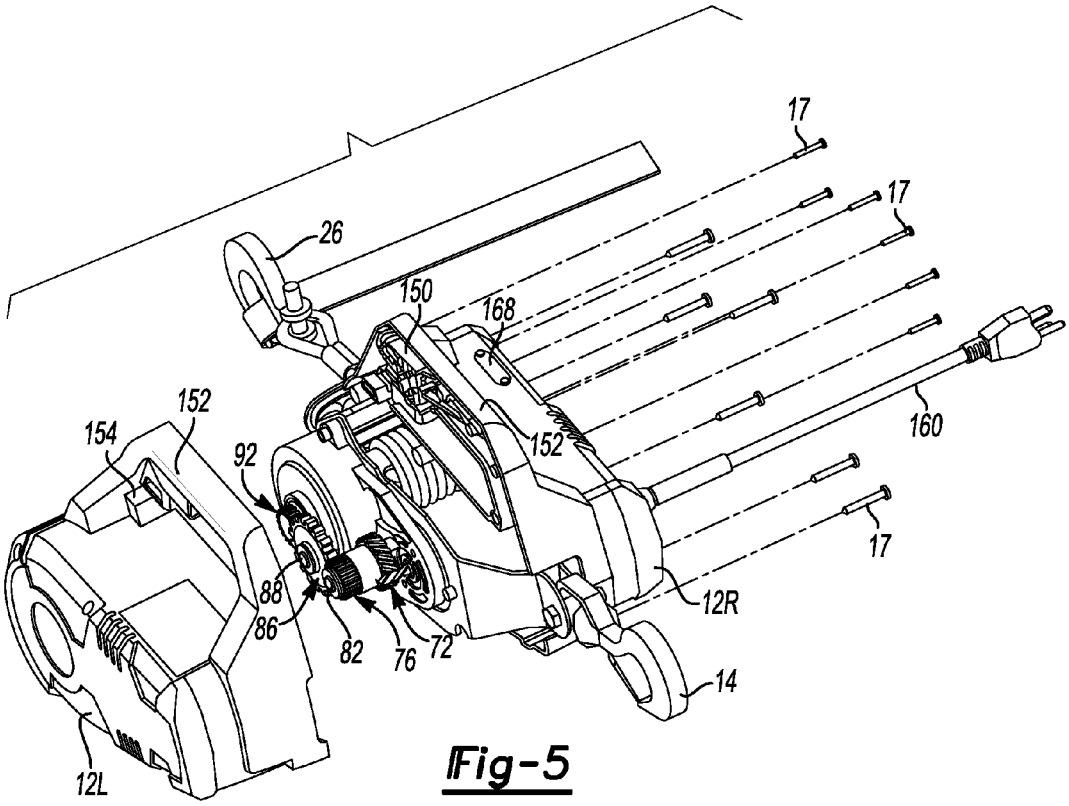
FIG. 5 is a perspective partially exploded view of the portable pulling tool with the left hand housing removed for illustration purposes.
Figure 16:
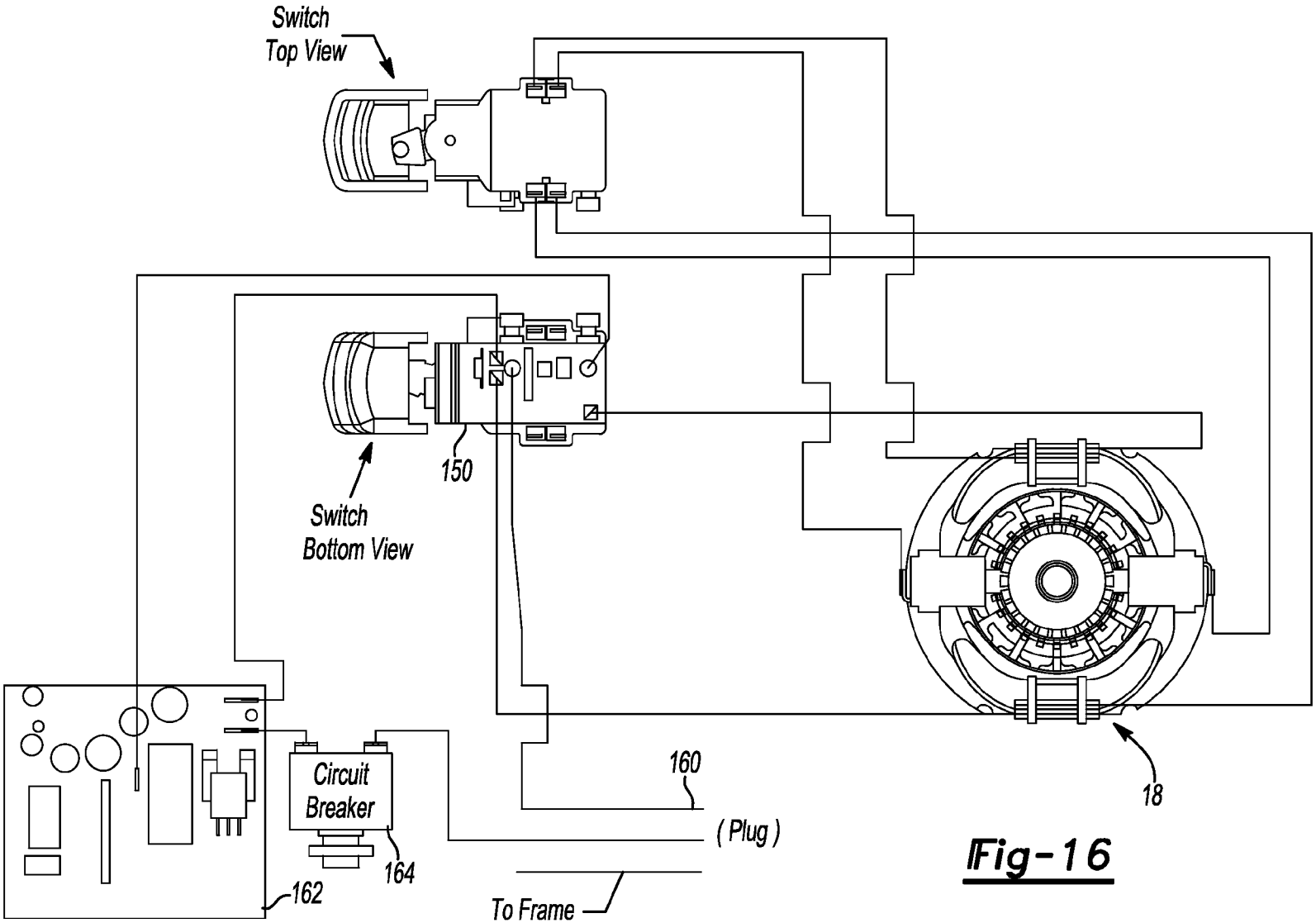
FIG. 16 is a schematic diagram of the pulling tool control circuit including the current limiter according to the principles of the present disclosure.
Figure 17:
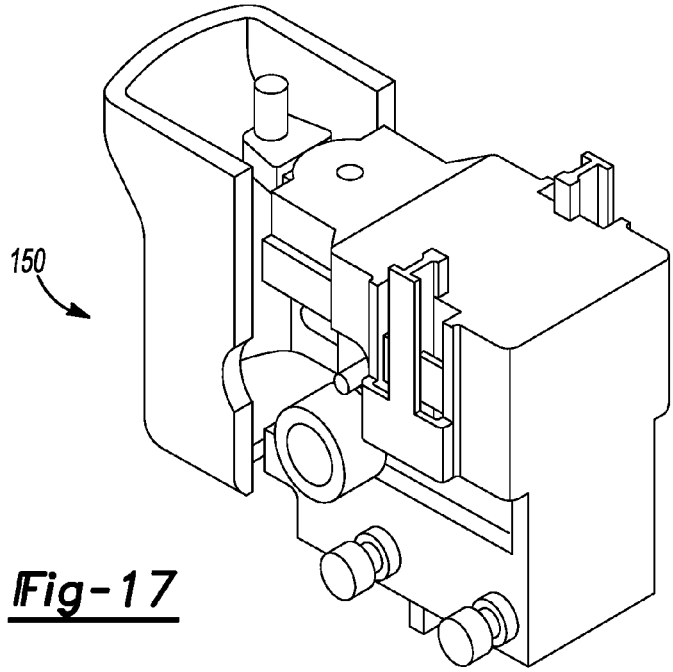
FIG. 17 is a perspective view of the trigger switch according to the principles of the present disclosure.
Figure 18:
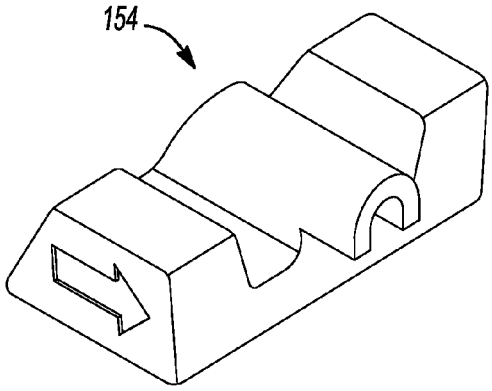
FIG. 18 is a perspective view of the direction switch according to the principles of the present disclosure.
Figure 19:
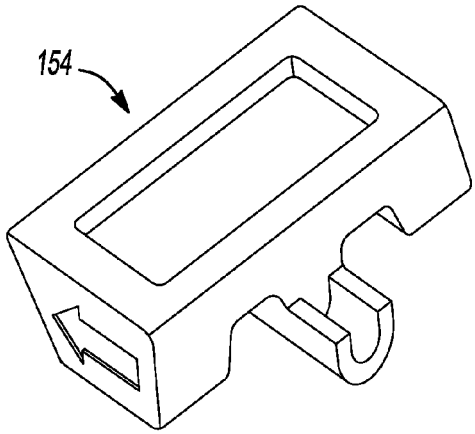
FIG. 19 is a second perspective view of the direction switch according to the principles of the present disclosure.
Figure 20:
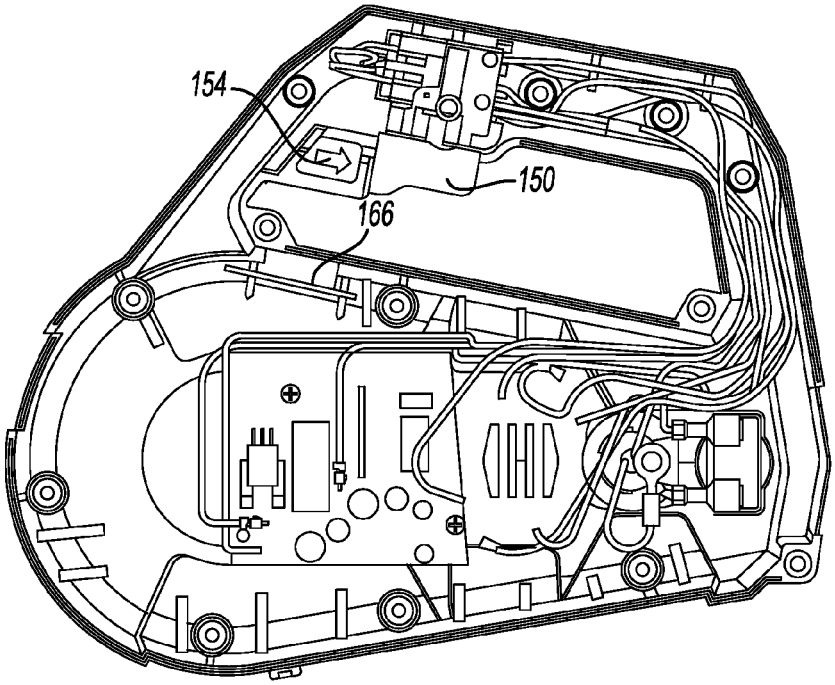
FIG. 20 is a side plan view of the portable pulling tool with a portion of the housing removed for illustrating the wire harness connections according to the principles of the present disclosure.
Figure 21:
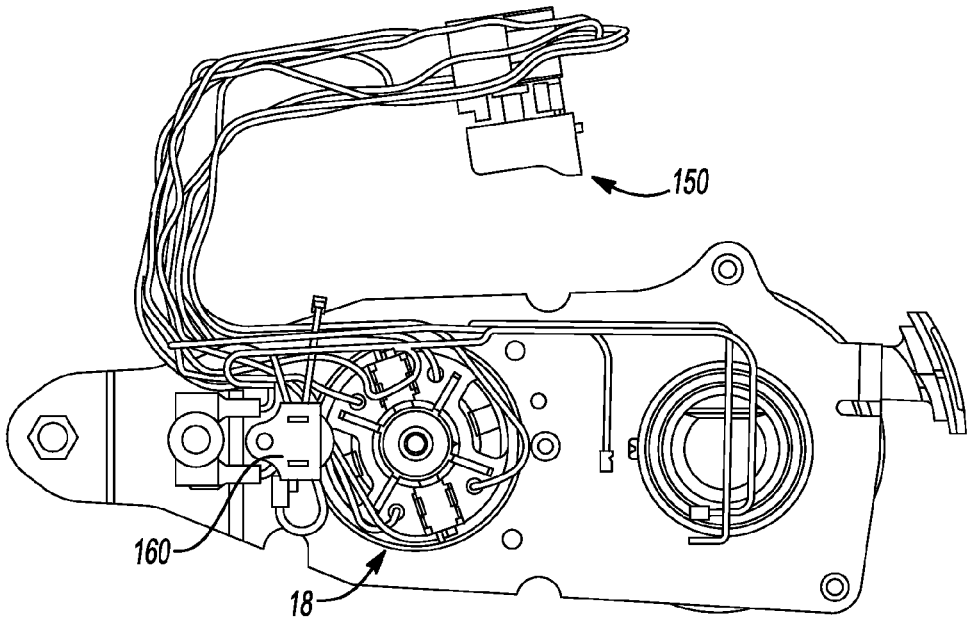
FIG. 21 is a plan view of the wire harness connections according to the principles of the present disclosures.

As illustrated in FIG. 4, the portable pulling tool 10 is provided with a trigger switch 150 which is mounted to a handle portion 152 of the housing 12. In addition, a direction switch 154 is also mounted to the handle portion 152. As shown in FIGS. 16, 19 and 20, the portable pulling tool 10 is provided with a wire harness for connecting the trigger switch 150 to the power source, which can include an electric cord 160, and to the electric motor assembly 18. A current limiter device 162 along with a circuit breaker 164 are provided to sense to the current in the unit that is proportional to the given physical load on the system. By real time monitoring and processing the motor current waveforms, the controller drives a 10 segment LED bar 166 that indicates approximately how much load is on the system. By way of example, 5 segments of the 10 segment bar can equal 500 pounds being applied as a load to the system. The LED bar 166 is covered by a bezel 168 which is secured in place by screws 170. When the maximum load is achieved, the current limiter 162 shuts the motor off for a short period of time while blinking a set of LEDs indicating the unit is at an overload condition. This load limiter protects the high speed motor from being stalled. The direction switch 164 interacts with the trigger switch 150 to cause the trigger switch to activate the motor in forward and reverse directions.

Figure 22:
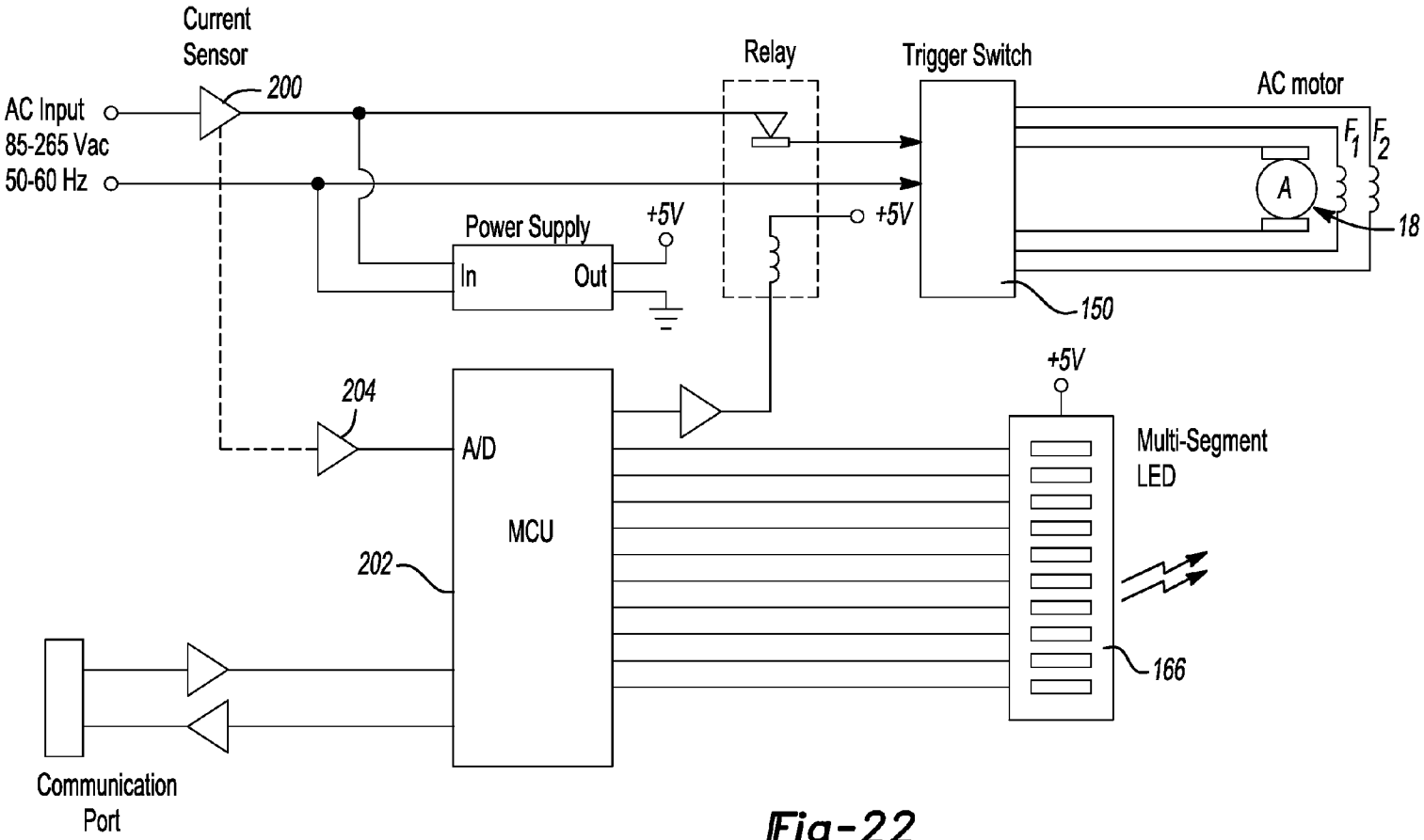
FIG. 22 is a block diagram of load limiter according to the principles of the present disclosure.
Figure 23A:
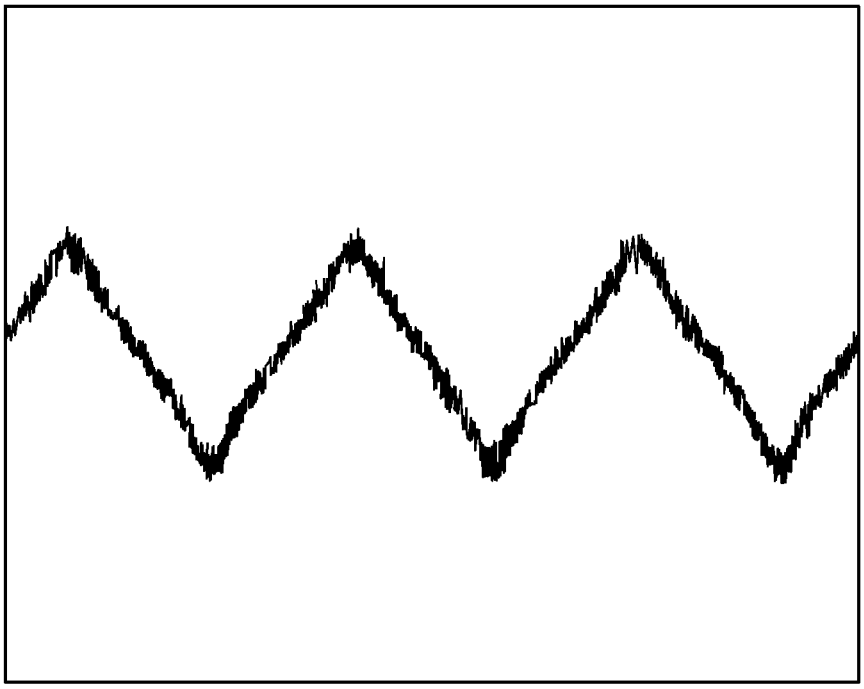
FIGS. 23*a*-23*c* illustrates various motor current waveforms according to the principles of the present disclosure.
Figure 23B:
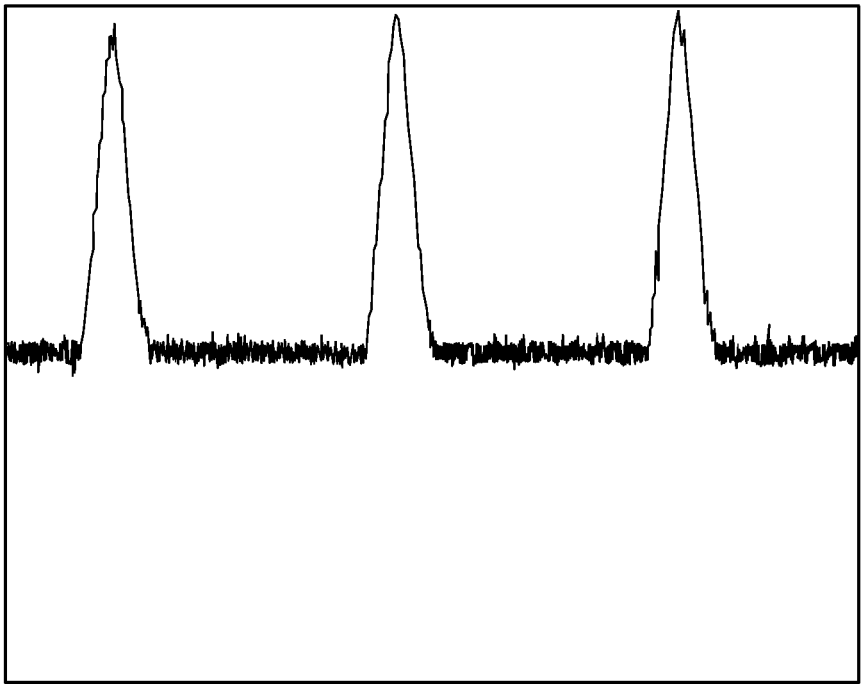
Figure 23C:
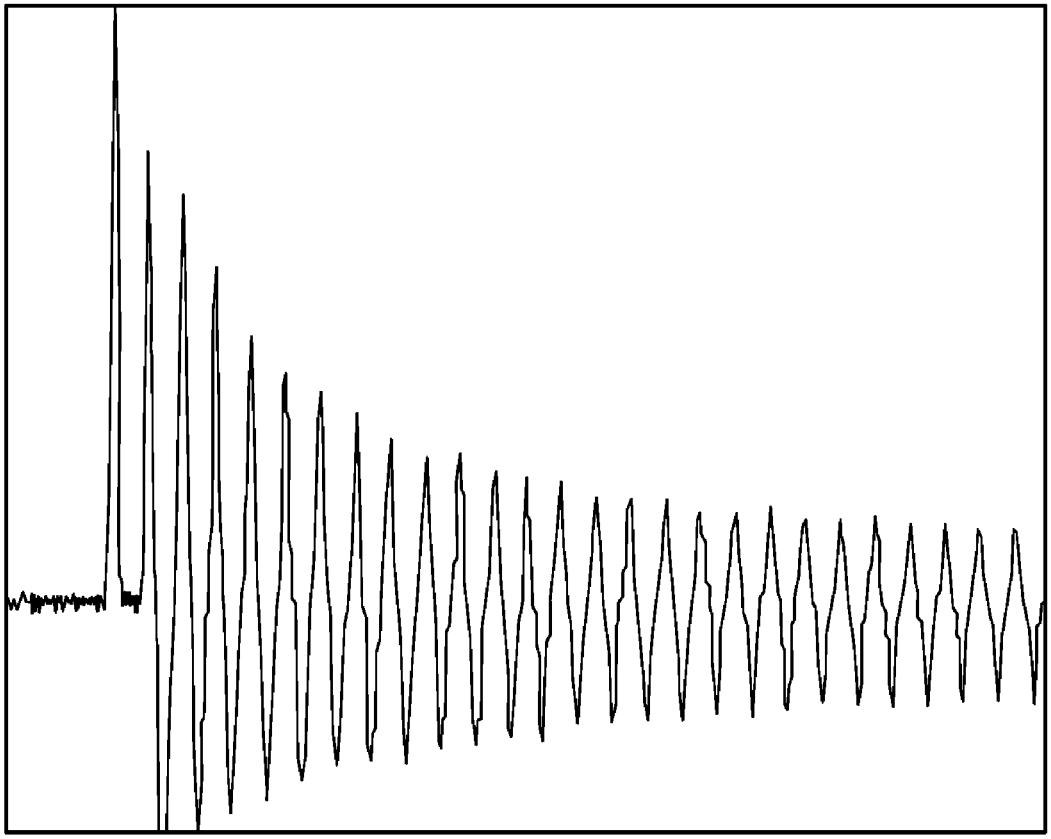

The control system for the portable pulling tool is shown schematically in FIG. 22. The control system includes a current limiter for preventing overload of the motor 18 of the portable pulling tool. A current sensor 200 is provided in communication with a micro-processor control unit 202 and includes an A to D converter 204 that converts a signal of the sensor 200 to a digital signal which is provided to the control unit 202. The control unit 202 is capable of receiving signals indicative of the motor current, such as illustrated in FIGS. 23*a*-23*c*. Because an alternating current is supplied to the motor 18, the current signal typically would include a series of triangular or sinusoidal voltage spikes. In particular, as illustrated in FIG. 23*a*, when the motor is operated at full speed, the motor current has generally triangular-shaped peaks and valleys which represent positive and negative peak values. Thus, as the motor is operated, the determination of the effective current being applied to the motor is not a straight forward operation since the current is constantly changing.

As illustrated in FIG. 23*b*, when the motor is operated at variable speed, the motor current is generally flat, with intermittent spikes that occur in order to give the variable speed output, as illustrated in FIG. 23*b*. Another problem encountered with sensing the motor current for purposes of limiting the current applied to the motor, is that at start-up, a motor in-rush current exists as illustrated in FIG. 23*c*. In particular, high spikes of current are required to start the motor rotating at start-up. Thus, the peaks encountered through the motor in-rush current at start-up have to be accounted for in order to employ a current limiter.

Figure 24A:
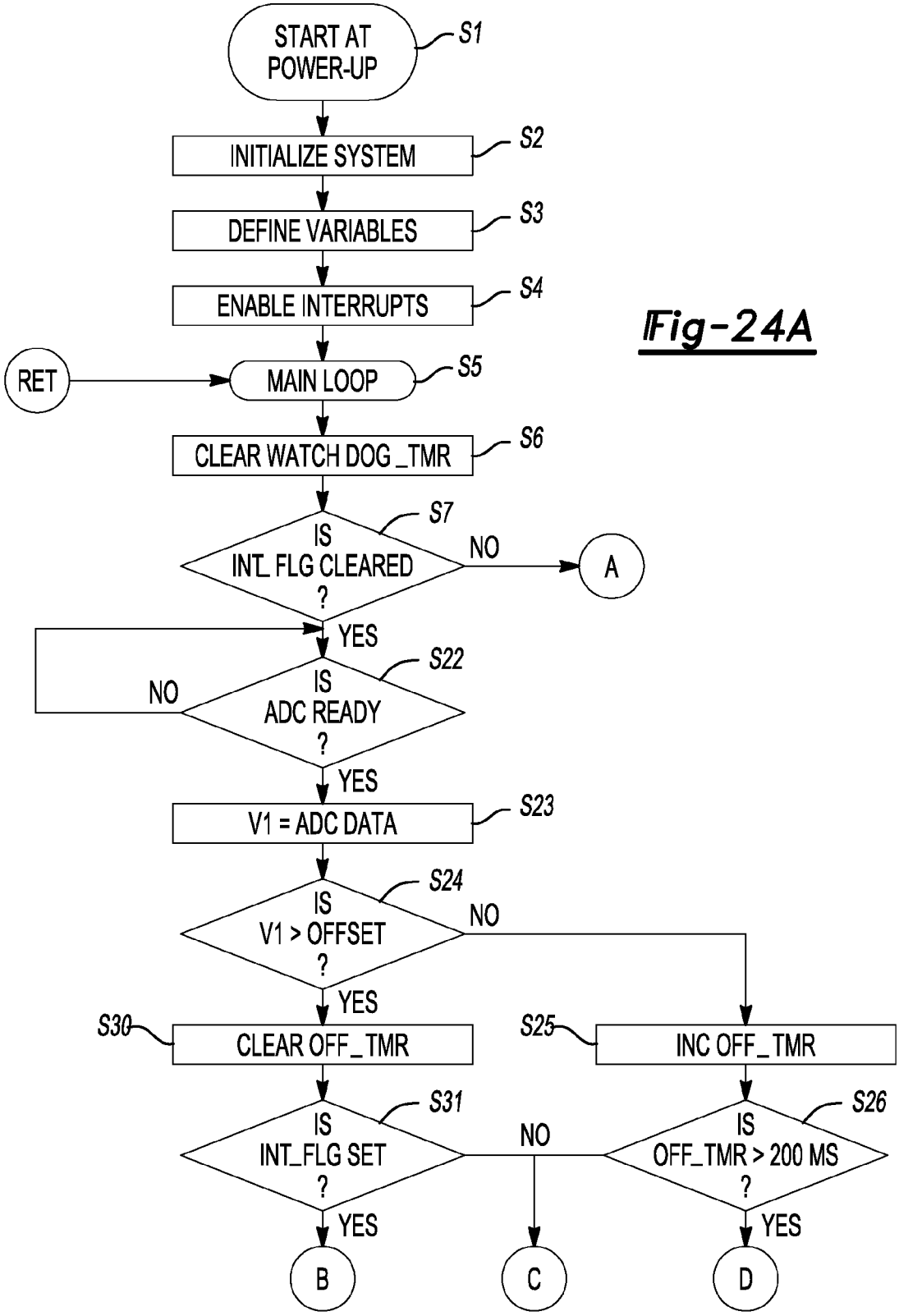
FIGS. 24*a*-24*c* is algorithm flow chart for processing and differentiating various motor waveforms.
Figure 24B:
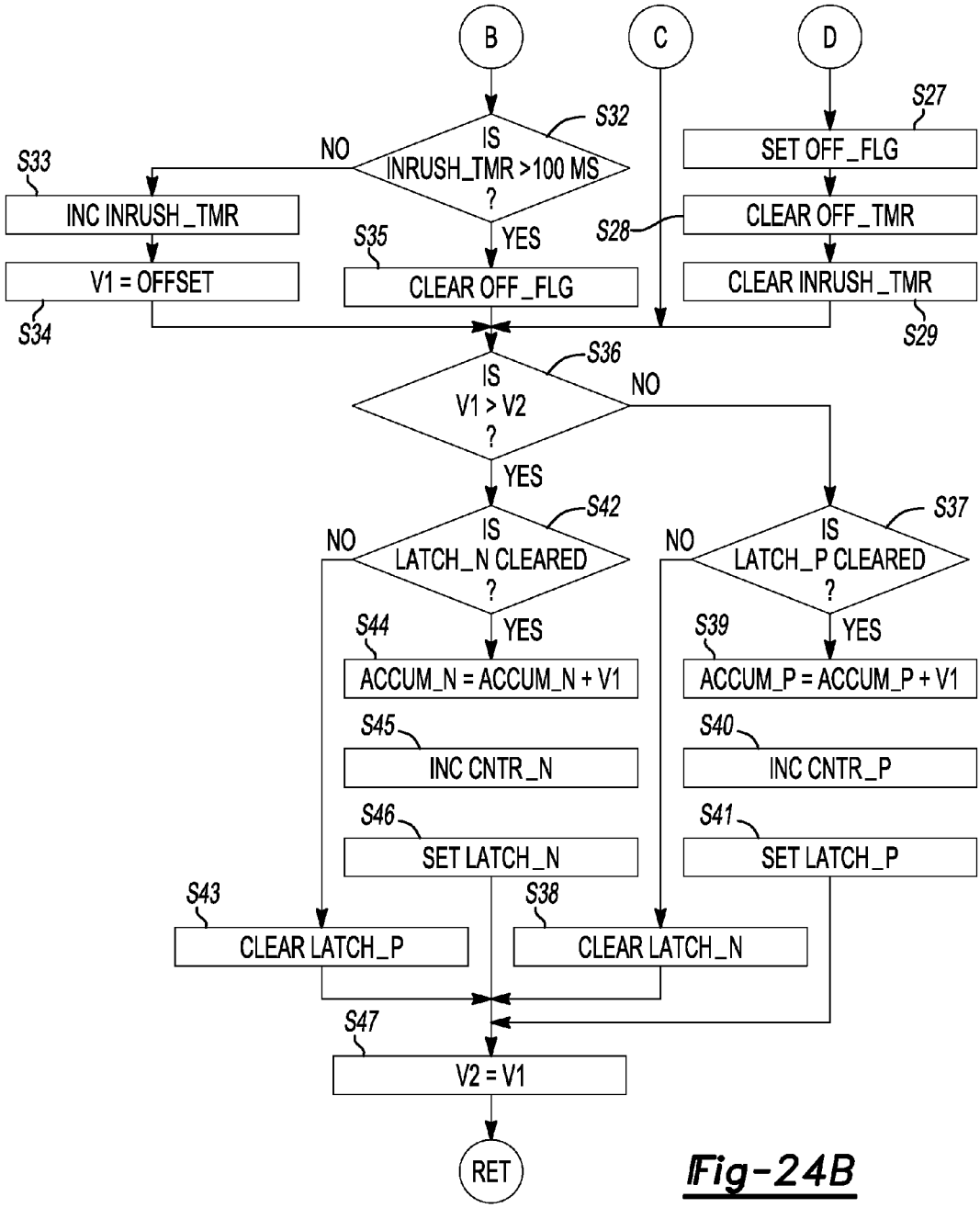
Figure 24C:
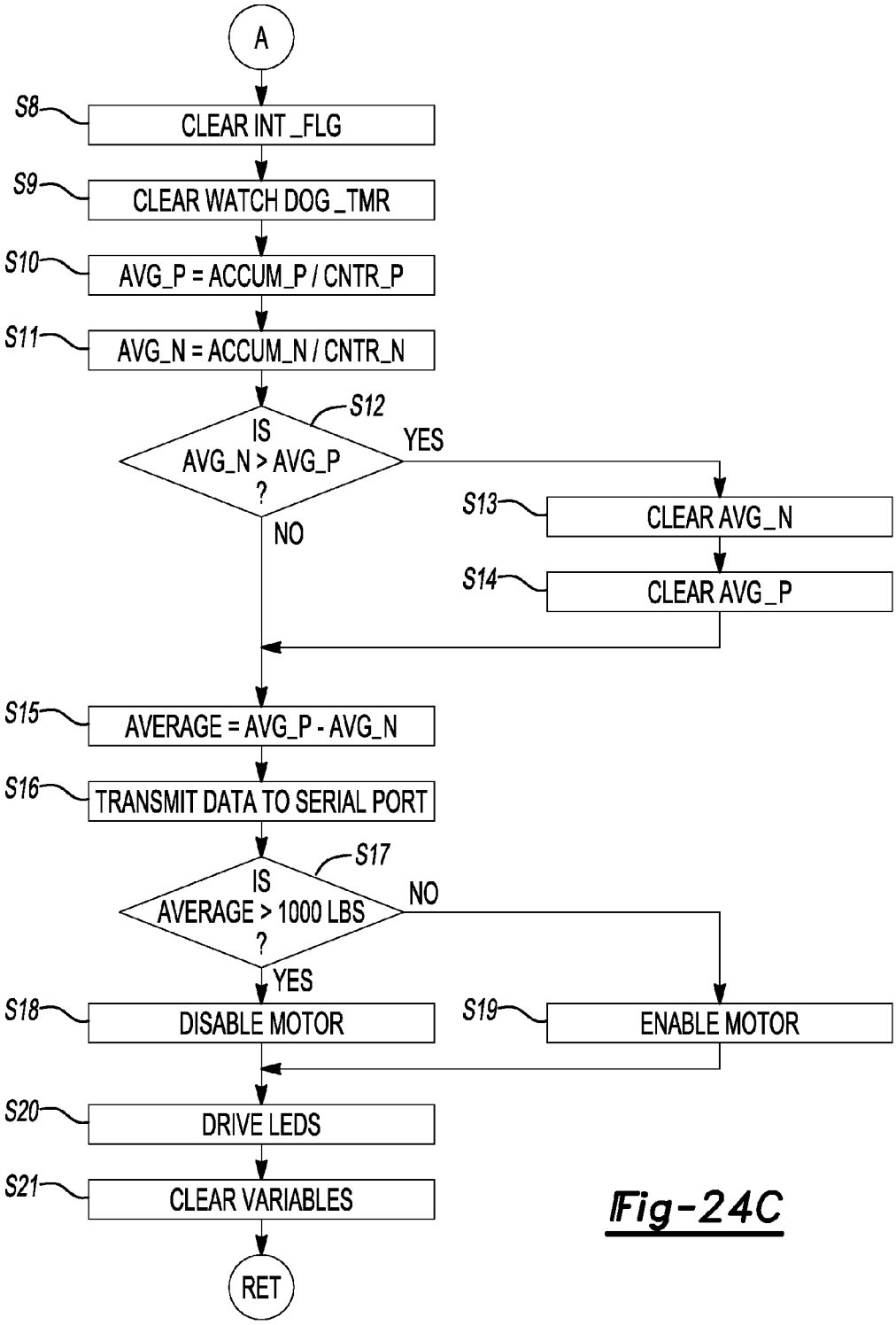

The program flowchart for the current limiter is illustrated in FIGS. 24*a*-24*c*. The current limiter program starts at power-up at Step S1. The system is then initialized at Step S2, and variables are defined at Step S3. At Step S3, the data is stored and the average offset flags, which will be discussed herein, are set. The routines and structure of the program flowchart are interrupt driven and are checked at 200 millisecond intervals. Accordingly, at Step 4, the interrupt intervals are enabled. The system then enters the main loop at Step S5 and proceeds to clear the watch dog timer at Step S6. At Step S7, it is determined whether the interrupt flag is cleared for the 200 millisecond interval loop. If, at Step S7, it is determined that the interrupt flag is not cleared, the control proceeds to sub-routine A, as illustrated in FIG. 24*c*.

In sub-routine A, at Step S8, the interrupt flag is cleared. At Step S9, the watchdog timer is cleared. At Step S10, an average positive current (Avg P) reading is determined by the equation:

$$\text{Avg } P = \text{Accum } P / \text{Cntr } P$$

wherein Cntr P is equal to the number of readings taken, and Accum P is equal to the sum of the positive peak values that are read.

Also, at Step S11, the average negative current (Avg N) reading is determined where Avg N is determined as being equal to:

$$\text{Accum N}/\text{Cntr N}$$

At Step S12, it is determined whether the average negative current is greater than the average positive current. If it is determined at Step S12 that the average negative current is greater than the average positive current, then the value for average negative current and average positive current are cleared as Steps S13 and S14. The flow proceeds at Step S15 where the average current is determined based upon the difference between the average positive current and average negative current values. This data is then transmitted to the serial port at Step S16. At Step S17, it is determined whether the average value is greater than the load limit such as, for example, 1000 pounds. If the average current exceeds the threshold limit, the motor is disabled at Step S18. If the average current does not exceed the threshold level, the motor is enabled at Step S19. The LEDs 166 are then driven at Step S20 according to the determined average current level so as to provide an indicator to the user where the load level is at. At Step S21, the variables are cleared and the sub-routine is returned to the main loop Step S5.

With continued reference to FIG. 24*a*, if at Step S7, it was determined that the Interrupt Flag is cleared, the flow proceeds to Step S22 where it is determined whether the analog-to-digital converter is ready. If the analog-to-digital converter is not ready, the flow circulates on a delay cycle until the analog-to-digital converter is determined to be ready, at which time the flow proceeds to Step S23 where the voltage value V1 is set equal to the analog-to-digital converter data signal. At Step S24, it is determined whether the voltage V1 value is greater than the offset value in order to determine if the motor is running. If the V1 value is not greater than the offset, then the motor is off, and the flow proceeds to Step S25 where the "off" timer is incremented. The flow then proceeds to Step S26 where it is determined whether the "off" timer is greater than 200 milliseconds. If it is determined that the "off" timer has been off for greater than 200 milliseconds, the flow proceeds to sub-routine D in which the "off" flag is set at Step S27 and the "off" timer is cleared at Step S28 and the in-rush timer is cleared at Step S29. Returning to FIG. 24*a*, if, at Step S26, it is determined that the "off" timer is less than 200 milliseconds, the flow proceeds to sub-routine C as shown in FIG. 24*b*.

Now returning to Step S24, if it is determined that the voltage value V1 is greater than the offset, and it is then determined that the motor is running, the flow proceeds to Step S30 where the "off" timer is cleared. The flow then proceeds to Step S31 where it is determined if the "off" flag is set. If it is determined that the "off" flag is not set, the flow proceeds to sub-routine C, as illustrated in FIG. 24*b*. If it is determined that the "off" flag is set, flow proceeds to sub-routine B, as illustrated in FIG. 24*b*. In sub-routine B, the flow proceeds to Step S32 where it is determined if the in-rush timer is greater than 100 milliseconds. This determination step determines whether the time period for startup has expired, during which the voltage reading during the in-rush startup period are not reliable. If, at Step S32 it is determined that the in-rush timer is not greater than 100 milliseconds, the flow proceeds to Step S33 where the in-rush timer is incremented, and at Step S34, the value for V1 is set equal to the offset value. If, at Step S32, it is determined that the in-rush timer does exceed 100 milliseconds, the flow proceeds to Step S35 where the "off" flag is cleared.

The flow from sub-routines B, C, and D are all continued at Step S36 where it is determined whether the voltage V1 is greater than the voltage V2. This determination is made in order to determine if the voltage is increasing relative to the prior reading such that a peak data point can be captured. If the voltage V1 is not determined to be greater than V2, the flow proceeds to Step S37 where it is determined whether the latch positive current value (Latch P) is cleared. If the Latch P value is not cleared, the flow proceeds to Step S38 where the Latch N value is cleared. If, at Step S37, it is determined that the Latch P value is cleared, the flow proceeds to Step S39 where the value accumulated P (Accum P) is set equal to Accum P+V1 in order to provide the positive peak value of the current curve. In Step S40, the counter P value (Cntr P) is incremented and at Step S41, the Latch P value is set.

Returning now to Step S36, if it is determined that the voltage V1 value is greater than the voltage V2 value, the flow proceeds to Step S42 where it is determined whether the Latch N value is cleared. If it is determined that the Latch N value is not cleared, the flow proceeds to Step S43 where the Latch P value is cleared. If it is determined that the Latch N value is cleared at Step S42, the flow proceeds to Step S44 where the accumulated negative value (Accum N) is set equal to the Accum N+V1 value in order to provide a peak negative current value. The counter N (Cntr N) is then incremented at Step S45 and the Latch N value is set at Step 46. The flow then proceeds to Step S47 where the value V2 is set equal to V1 and the flow is returned to the main loop at Step S5. The Steps S36-S46 provide the peak values of the current waveforms so that these peak values can be utilized in the current limiter algorithm. It is the average positive (Avg P) and average negative (Avg N) current values at the peaks that are utilized for determining the accumulated positive peak values (Accum P) and accumulated negative peak values (Accum N) that are then divided by the number of readings taken (the counter values Cntr P, Cntr N) that yield the average negative peak value (Avg N) and average positive peak values (Avg P) that are utilized in flow sub-routine A for determining whether the current limit has been reached for either enabling or disabling the motor. These values are also utilized for driving the LEDs to indicate to the user the amount of load on the pulling tool.

What is claimed is:

1. A pulling tool, comprising:

a bracket assembly including first and second brackets, said first and second brackets each having a planar portion, said planar portions disposed in parallel spaced relation to each other;

a drum rotatably supported between said first and second bracket planar portions, said drum having a cable wound thereon;

a motor supported by, and disposed between, each of said first and second bracket planar portions at a location laterally offset from an axis of said drum; and a drive train connected between said drive motor and said drum for transmitting drive torque from said motor to said drum, said drive train being supported by an integrally formed one piece gear housing including a first aperture for receiving a drive shaft of said motor, a second aperture for supporting at least one intermediate gear and a planetary gear housing portion rotatably supporting a sun gear, said sun gear being in meshing engagement with a planetary gear set disposed within said planetary gear housing portion.

2. The pulling tool according to claim 1, further comprising a first ring gear non-rotatably mounted in said planetary gear housing portion of said one-piece gear housing.

3. The pulling tool according to claim 1, wherein said planar portion of each of said first and second brackets includes a first surface and an opposite second surface, said first surfaces facing each other; and wherein said one piece gear housing is mounted to said second surface of said first bracket planar portion so as to be on an opposite side of said first bracket planar portion as said motor.

4. The pulling toll according to claim 3, wherein said drive shaft of said motor extends through an aperture in said first bracket.

5. The pulling tool according to claim 3, wherein said drive train is positioned adjacent to said second surface of said first bracket planar portion on an opposite side of said first bracket as said motor.

6. The pulling tool according to claim 3, wherein said first and second apertures of said one-piece gear housing are both positioned on the second side of the first bracket planar portion.

7. The pulling tool according to claim 3, further comprising a first ring gear non-rotatably mounted in said planetary gear housing portion and a second ring gear rotatably mounted in said planetary gear housing portion, said first and second ring gears each in direct meshing engagement with said planetary gear set.

8. The pulling tool according to claim 3, further comprising:

a housing having first and second portions coupled together and defining a handle; and a trigger switch mounted to the handle;

wherein said housing houses said bracket assembly, drum, motor and drive train.

9. A pulling tool, comprising:

a bracket assembly including first and second brackets;

a drum rotatably supported between said first and second brackets, said drum having a cable wound thereon;

a motor supported by, and disposed between, said first and second brackets at a location laterally offset from an axis of said drum; and a drive train connected between said drive motor and said drum for transmitting drive torque from said motor to said drum, said drive train being supported by an integrally formed one piece gear housing including a first aperture for receiving a drive shaft of said motor, a first helical gear driven by said motor, a second aperture for supporting at least one intermediate gear and a planetary gear housing portion rotatably supporting a sun gear, said sun gear being in meshing engagement with a planetary gear set disposed within said planetary gear housing portion.

10. The pulling tool according to claim 9, wherein said drive train further includes a second helical gear in meshing engagement with said first helical gear, said second helical gear being non-rotatably connected to said at least one intermediate gear.

11. The pulling tool according to claim 10, further comprising a second intermediate gear in meshing engagement with said at least one intermediate gear and drivingly engaged with said sun gear.

12. The pulling tool according to claim 11, wherein said sun gear includes a first gear portion meshingly engaged with said second intermediate gear and a second gear portion engaged with said planetary gear set.

13. A pulling tool, comprising:

a drive motor;

a drum having a cable wound thereon; and a drive train connected between said drive motor and said drum for transmitting drive torque from said motor to said drum, said drive train including a first helical gear driven by said motor, a second helical gear in meshing engagement with said first helical gear, at least one intermediate gear in driving engagement with said second helical gear and a differential planetary gearset drivingly connected to said at least one intermediate gear, said differential planetary gearset including a sun gear in driving engagement with said at least one intermediate gear, a plurality of planetary gears in meshing engagement with said sun gear, a fixed ring gear in meshing engagement with said plurality of planetary gears and a rotatable ring gear in meshing engagement with said plurality of planetary gears, said rotatable ring gear being connected to said drum.

14. The pulling tool according to claim 13, further comprising a first bracket for rotatably supporting said drum.

15. The pulling tool according to claim 14, wherein said drive motor is disposed between said first bracket and an integrally formed one piece gear housing, said one-piece gear housing including a first aperture for receiving a drive shaft of said motor, a second aperture for supporting said at least one intermediate gear and a planetary gear housing portion rotatably supporting said sun gear, said planetary gear set being disposed within said planetary gear housing portion of said one-piece gear housing.

16. The pulling tool according to claim 15, further comprising a second bracket for rotatably supporting said drum.

17. The pulling tool according to claim 16, wherein said one-piece gear housing is mounted to said second bracket.

18. The pulling tool according to claim 14, further comprising a second bracket for rotatably supporting said drum, said drive motor being disposed between said first and second brackets.

19. The pulling tool according to claim 13, wherein said at least one intermediate gear is non-rotatably connected to said second helical gear.

20. The pulling tool according to claim 19, further comprising a second intermediate gear in engagement with said at least one intermediate gear and in further meshing engagement with a third intermediate gear which is non-rotatably connected with said sun gear.

21. A pulling tool, comprising:

a drive motor;

a drum having a cable wound thereon;

a drive train connected between said drive motor and said drum for transmitting drive torque from said drive motor to said drum; and a motor control circuit including a control switch, a current limiter which disconnects said motor control circuit when a predetermined current level is achieved, and an indicator light bar having a plurality of indicator lights positioned in stacked spaced relation to each other and which are indicative of a load applied to said pulling tool, said light bar including a first indicator light and a last indicator light and a plurality of indicator lights therebetween such that as an increasing load is being applied to said pulling tool, a proportional number of the indicator lights are illuminated starting from the first light and progressing towards the last light to provide a visual indication of the amount of load being applied to the tool relative to a maximum applicable load, wherein illumination of all of the indicator lights including the last light provides a visual indication of the maximum load or predetermined current level being reached upon which the current limiter will disconnect said motor control circuit to disable said drive motor.

22. A pulling tool, comprising:

a drive motor;

a drum having a cable wound thereon;

a drive train connected between said drive motor and said drum for transmitting drive torque from said drive motor to said drum; and a motor control circuit including a control switch and a current limiter which disconnects said motor control circuit when a predetermined current level is achieved, wherein said current limiter determines an average positive and an average negative peak current value, wherein a difference between the average positive peak current value and the average negative peak current value is compared to a predetermined value for determining whether the current limit is exceeded for disabling the drive motor.

23. A pulling tool, comprising:

a bracket assembly including first and second brackets, said first and second brackets each having a planar portion, said planar portions disposed in parallel spaced relation to each other;

a drum rotatably supported between said first and second bracket planar portions, said drum having a cable wound thereon;

a motor supported by, and disposed between, each of said first and second bracket planar portions at a location laterally offset from an axis of said drum;

a drive train connected between said drive motor and said drum for transmitting drive torque from said motor to said drum; and a hook secured between said first and second brackets.

24. The pulling tool according to claim 23, further comprising a housing covering said motor, said drum, said drive train and said planar portion of said first and second brackets.

25. The pulling tool according to claim 24, wherein said housing includes a handle.

26. The pulling tool according to claim 25, further comprising a trigger switch mounted to the handle.

27. The pulling tool according to claim 24, wherein said first and second brackets include end portions extending outward from said housing and said hook is attached to said end portions of said first and second brackets.

* * * * *